United States Patent [19]

Hollan et al.

[11] Patent Number: 4,951,990

[45] Date of Patent: Aug. 28, 1990

[54] FIFTY FIVE GALLON DRUM HANDLING APPARATUS

[75] Inventors: Brad L. Hollan, Oxnard; James E. Osgood, Camarillo, both of Calif.

[73] Assignee: The United States of America as represented by the Secretary of the Navy, Washington, D.C.

[21] Appl. No.: 417,215

[22] Filed: Oct. 3, 1989

[51] Int. Cl.[5] ..... B66C 1/44; B66F 9/18

[52] U.S. Cl. ..... 294/119.1; 294/86.41; 414/607; 414/621; 414/785; 414/912

[58] Field of Search ..... 294/67.33, 81.2, 81.21, 294/81.54, 81.62, 86.4, 86.41, 88, 90, 93, 103.1, 119.1, 902; 414/607, 608, 618–621, 785, 911, 912

[56] References Cited

U.S. PATENT DOCUMENTS

| | | | |
|---|---|---|---|
| 169,559 | 11/1875 | Lugenbell . | |
| 1,862,299 | 6/1932 | Ciccone . | |
| 2,645,372 | 7/1953 | Broersma | 414/620 |
| 2,755,949 | 7/1956 | Schenkelberger | 414/621 X |
| 2,795,347 | 6/1957 | Schenkelberger | 414/607 |
| 3,319,815 | 5/1967 | Vik | 414/607 |
| 3,674,164 | 7/1972 | Kaufman . | |
| 3,751,008 | 8/1973 | McNatt | 414/607 X |
| 3,970,342 | 7/1976 | Cotton | 294/119.1 X |
| 4,051,966 | 10/1977 | Cotton | 414/620 X |
| 4,272,220 | 6/1981 | Garcia | 294/119.1 X |
| 4,318,661 | 3/1982 | Helm | 294/119.1 X |
| 4,685,854 | 8/1987 | Bulle | 414/452 |
| 4,741,659 | 5/1988 | Berg | 294/90 X |

*Primary Examiner*—Johnny D. Cherry

*Attorney, Agent, or Firm*—David S. Kalmbaugh

[57] ABSTRACT

A drum handling apparatus adapted for use with an integrated tool carrier vehicle or a forklift which has coupled thereto a tire handling attachment. The tire handling attachment has a pair of L shaped members which extend and retract. Located at the free end of the L shaped members are rotatable engaging elements. The drum handling apparatus includes a pair of square shaped tubular members in slidable engagement, with each tubular member having at the free end thereof a circular plate which attaches to one of the rotatable gripping elements of the tire handling attachment. Each tubular member has affixed thereto a curved plate with the curved plates to be utilized to grip a barrel or drum when the L shaped members of the tire handling attachment are retracted and release the barrel or drum when the L shaped members of the tire handling attachment are extended.

13 Claims, 3 Drawing Sheets

FIFTY FIVE GALLON DRUM HANDLING APPARATUS

BACKGROUND OF THE INVENTION

1. Field of the Invention

This invention relates generally to an apparatus for moving barrels, drums or the like. In particular, this invention relates to a sixteen, thirty five, and fifty five gallon drum handling apparatus which may be used with an integrated tool carrier vehicle, forklift, or the like.

2. Description of the Prior Art

There is disclosed in the prior art a number of hand trucks and carts for moving barrels and drums. For example, U.S. Pat. No. 1,862,299 discloses a convertible hand truck body with each arm having curved keg engaging plates to clamp a keg or barrel. In U.S. Pat. No. 169,559, a hand truck is disclosed which utilizes two shafts united at the end by adjustable cross-pieces, each shaft being provided with a movable sleeve carrying a pointed clutch capable of being fastened to the heads of barrel. In U.S. Pat. No. 4,685,854, a hand cart is disclosed which is adapted for carrying a stack of materials such as tires, barrels and the like utilizing a pair of arms activated by foot pedals to open and close the arms.

A short coming of these prior art hand trucks in general has been their inability to remove barrels from or load barrels onto drum racks, elevated platforms such as the pallets which are commonly utilized in connection with forklift trucks, and elevated surfaces such as a truck bed. A second short coming of prior art hand trucks has been their inability to allow an operator to pour a liquid directly from a drum or elevate the drum over a vehicle to allow the drum's liquid to pour from the drum into the vehicle.

There is also disclosed in the prior art drum lifter mechanisms adapted for use with fork lift trucks and the like. An example of this type of prior art is U.S. Pat. No. 4,272,220 which discloses a drum lifter mechanism adapted for reception over the vertically adjustable forks of a forklift truck and which includes a pair of opposed drum-engaging jaws capable of pivotal movement about horizontal and vertical axes for encompassing and gripping a drum.

While this device of the prior art is satisfactory for its intended purpose of lifting and transporting a drum, there are several shortcomings in this prior art drum lifting mechanism including its inability to pour liquid from a drum, and the complexity of its design.

With these and other disadvantages known to prior art drum lifting and moving mechanisms, the present invention was conceived and one of its objectives is to provide an apparatus for moving drums, barrels or the like which is simple and inexpensive and which is adapted for use with an integrated tool carrier vehicle or a forklift.

It is another object of the present invention to provide an apparatus for moving barrels or drums to and from an elevated platform or drum rack and which accommodates platforms or drum racks of various heights.

It is still another object of the present invention to provide an apparatus for pouring a liquid directly from a drum or elevate the drum over a vehicle to allow the drum's liquid to pour from the drum into the vehicle.

Various other advantages and objectives of the present invention will become apparent to those skilled in the art as a more detailed description of the invention is set forth below.

SUMMARY OF THE INVENTION

The objects of the present invention are satisfied by a drum handling apparatus adapted for use with an integrated tool carrier vehicle or a forklift which has coupled thereto a tire handling attachment. The tire handling attachment has a pair of L shaped members which extend and retract. Located at the free end of the L shaped members are rotatable engaging elements The present invention includes a pair of square shaped tubular members in slidable engagement, with each tubular member having at the free end thereof a circular plate which attaches to one of the rotatable gripping elements of the tire handling attachment. Each tubular member has affixed thereto a curved plate with the curved plates be utilized to grip a barrel or drum when the L shaped members of the tire handling attachment are retracted and release the barrel or drum when the L shaped members are extended.

DETAILED DESCRIPTION OF THE PREFERRED EMBODIMENT

Figure 1:
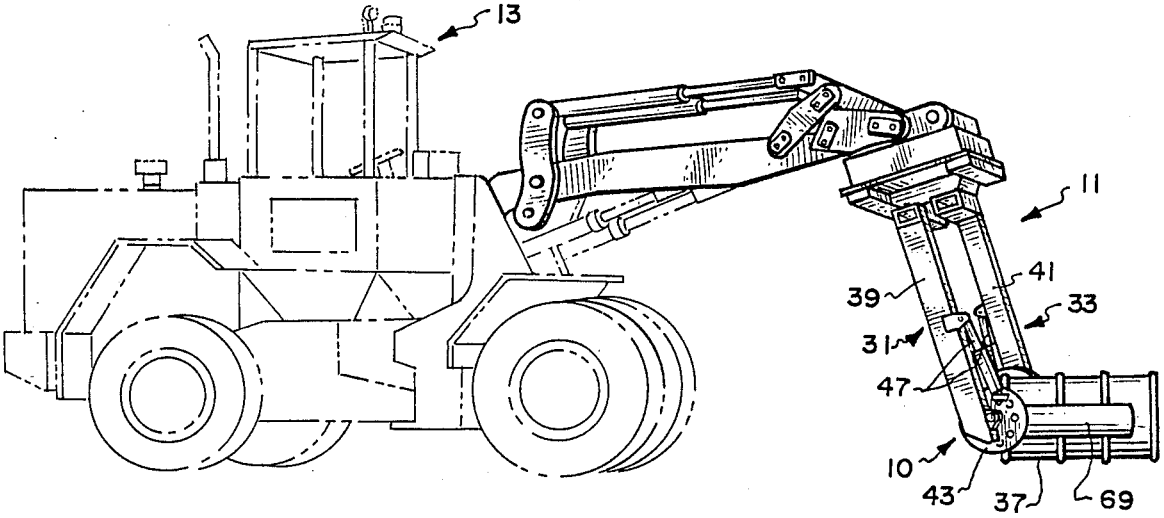
FIG. 1 is a perspective view of the present invention being utilized with a tire handling apparatus coupled to an integrated tool carrier vehicle.

Referring first to FIG. 1, there is shown a drum handling apparatus 10 constituting the present invention which is illustrated as being affixed to a tire handling mechanism 11. Tire handling mechanism 11 is, in turn, coupled to a commercially available integrated tool carrier vehicle 13 such as the model IT 28 integrated tool carrier manufactured by Caterpillar Inc.

Figure 2:
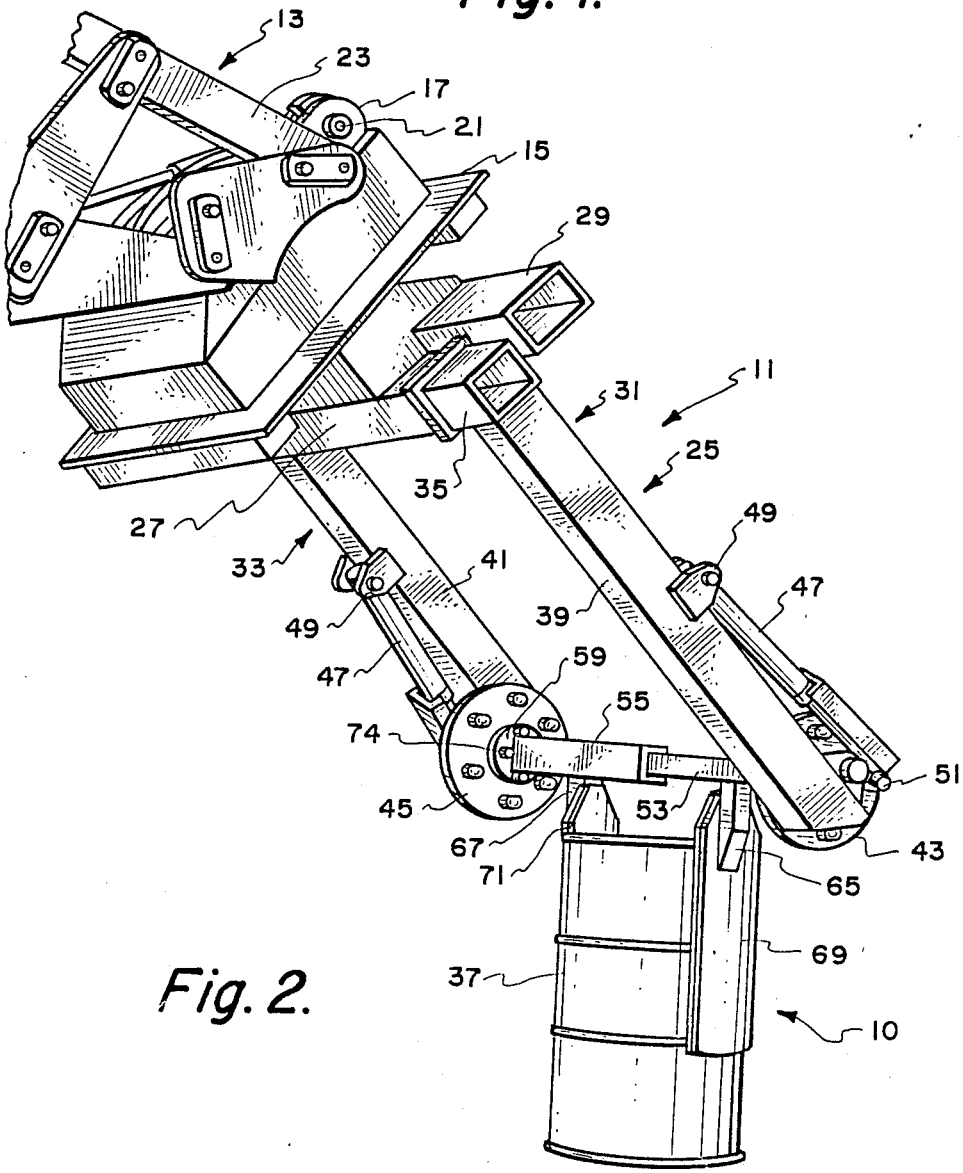
FIG. 2 is an enlarged perspective view illustrating the drum handling apparatus of the present invention affixed to the tire handling apparatus of FIG. 1.

Referring now to FIG. 2, tire handling apparatus 11 includes a mounting plate 15 at the upper rear of which are aligned bosses 17 adapted to receive a pin 21 which supports mounting plate 15 upon a carriage 23 of integrated tool carrier vehicle 13. At this time it should be noted that tire handling apparatus 11 is a commercially available tire manipulating mechanism Model No. 1449 Tirehand manufactured by Iowa Mold Tooling Co. Inc. of West Garner, Iowa and is fully disclosed in U.S. Pat. No. 4,051,966 which issued on Oct. 4, 1977 to Larry G. Cotton.

Gripping means, indicated generally at 25 is rotatably mounted on plate 15. Gripping means 25 consist of a pair of spaced tubular housings 27 and 29 which are rotatably secured to mounting plate 15. L shaped members 31 and 33 are operatively associated, respectively, with housings 27 and 29. L shaped member 31 has a first arm 35 which is telescoped in housing 27 while L shaped member 33 has a first arm, not shown, which is telescoped in housing 29.

Linear motors, not shown, are mounted in housings 27 and 29 and are operatively connected to L shaped members 31 and 33 to extend and retract the latter for the purpose of gripping or releasing a drum 37.

The L shaped members 31 and 33 also include second arms 39 and 41 which are respectively integral with the first arms of members 31 and 33. Opposed engaging elements 43 and 45 are rotatably mounted, respectively, on arms 39 and 41. Rotary motion of engaging elements 43 and 45 is provided by a pair of hydraulic cylinder and piston units 47, each of which has one end pivotally mounted upon a bracket 49 on arm 39 or 41 and the other end of which is pivotally connected to a bracket 51 on the associated engaging element 43 or 45.

Figure 3:
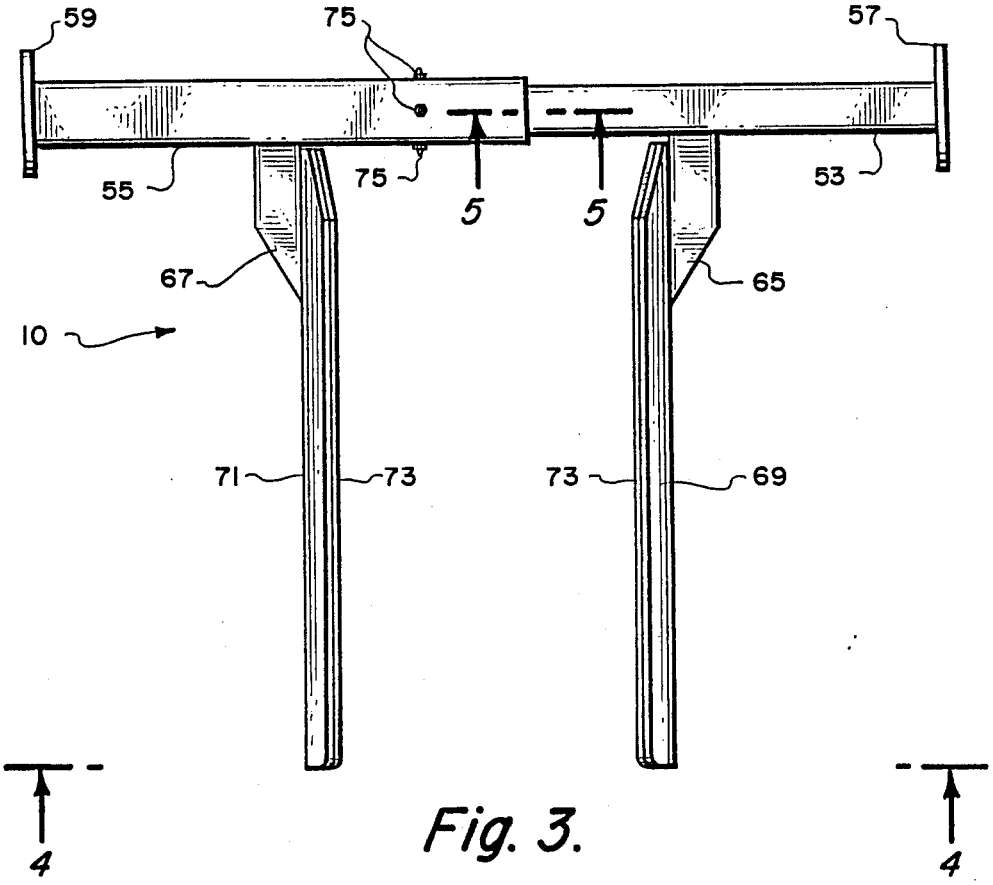
FIG. 3 is a top view illustrating the drum handling apparatus constituting the present invention.
Figure 4:
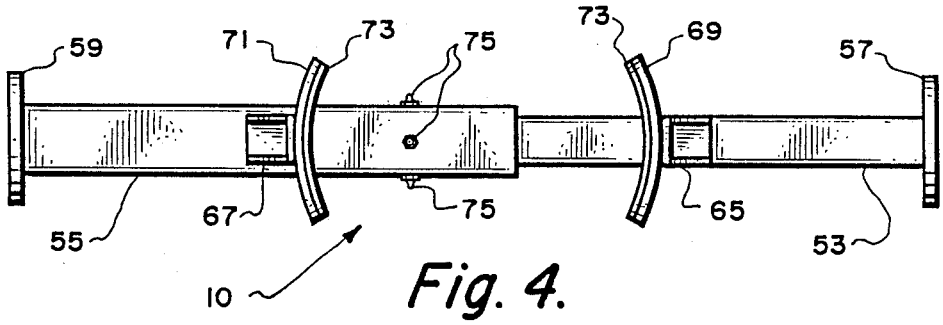
FIG. 4 is a frontal view of the drum handling apparatus constituting the present invention.

Referring now to FIGS. 3 and 4, there is shown drum handling apparatus 10 which includes a pair of square shaped tubular members 53 and 55 with member 53 being in slidable engagement with and telescoping in member 55. There is attached to the free end of member 53 by a weld, not shown, a circular plate 57, while there is attached to the free end of member 55 by a weld, not shown, a circular plate 59.

Figure 5:
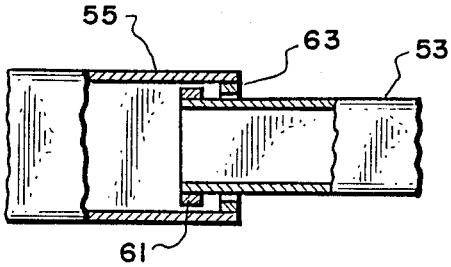
FIG. 5 is a sectional view of the telescoping tubular members of the present invention taken along the 5—5 of FIG. 3.

Referring to FIG. 5, the opposite end of member 53 has welded to the outside thereof a stop 61, while the opposite end of member 55 has welded to the inside thereof a stop 63 with stops 61 and 63 preventing members 53 and 55 from disengaging when drum handling apparatus 10 is being utilized with tire handling mechanism 11 to move drums or barrels.

Referring now to FIGS. 2, 3 and 4, there is shown a pair of braces 65 and 67 welded, respectively, at right angles to and extending forward from members 53 and 55. Attached, respectively, to braces 65 and 67 by means of welds, not shown, are a pair of opposed curved plates 69 and 71 which function to grip a barrel or drum when apparatus 10 is being utilized in an operational mode. Plates 69 and 71 each have affixed to the inner surface thereof an elastomeric material 73 such as rubber to provide a secure grip between plates 69 and 71 and the outer surface of barrel 37. A plurality of bolts 74 connect circular plates 57 and 59, respectively, to engaging elements 43 and 45, thus allowing for the engagement and removal of drum handling apparatus 10 from tire handling mechanism 11. A plurality of lubrication fittings 75 located on member 55 provide a means by which members 53 and 55 can be lubricated so that member 53 slides freely within member 55.

As is best illustrated in FIG. 4, plates 69 and 71 are positioned, respectively, near the center of members 53 and 55, with the positioning of plates 69 and 71 being critical to the operational effectiveness of drum handling apparatus 10. Further, it should be noted at this time that drum handling apparatus 10 may be used to move drum sizes ranging from sixteen to fifty five gallons with the drums having diameters ranging from 14.50 to 23.13 inches.

Figure 6:
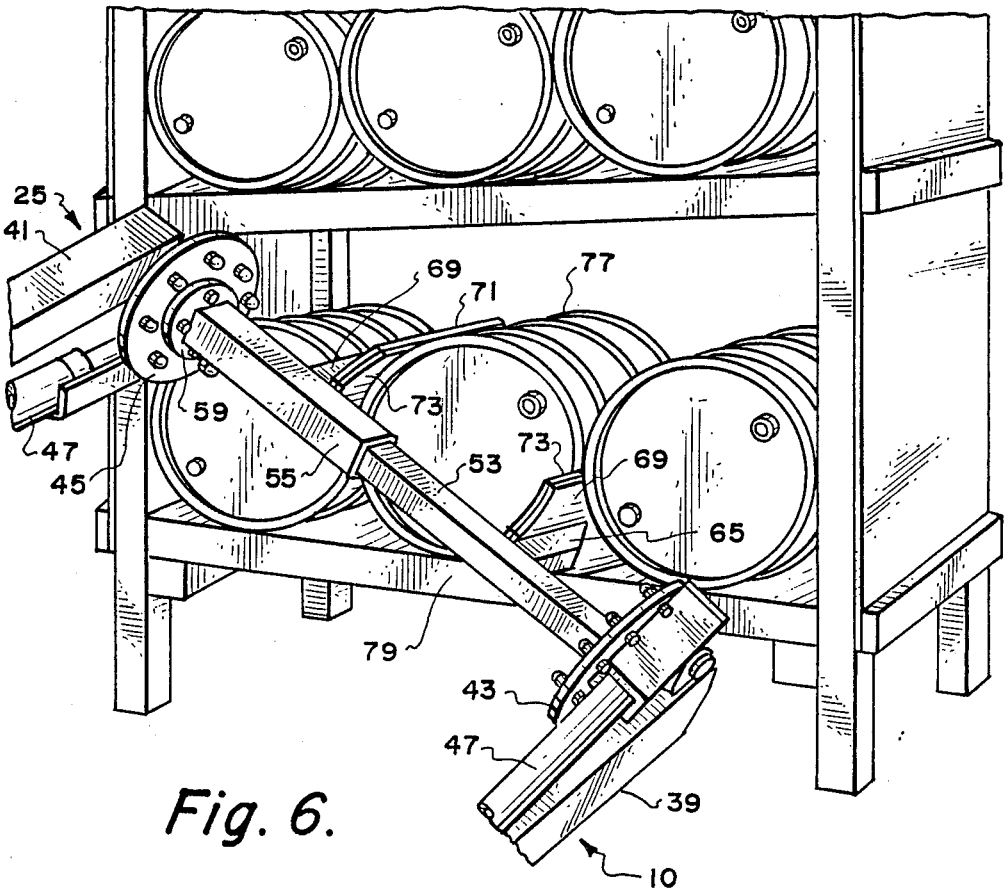
FIG. 6 illustrates the present invention being utilized to remove a drum from a drum rack.

Referring now to FIGS. 2 and 6, there is shown drum handling apparatus 10 being utilized to remove a drum 77 from a wooden drum rack 79. Gripping means 25 of tire handling mechanism 11 is rotated such that opposed curved plates 69 and 71 are positioned at an angle of approximately 45 degrees with respect to the ground to permit an operator to insert drum handling mechanism 10 into drum rack 79. The operator then moves vehicle 13, FIG. 1, forward to position curved plates 69 and 71 around drum 77. The operator can then activate the linear motors of gripping means 25 so as to retract L shaped members 31 and 33 for the purpose of allowing plates 69 and 71 to grip drum 77. The operator then moves vehicle 13 in a reverse direction providing for the removal of drum 77 from drum rack 79.

Figure 7:
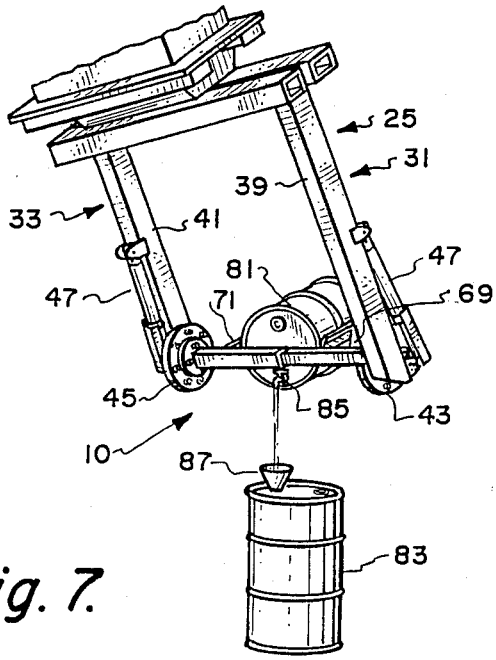
FIG. 7 illustrates the present invention being utilized to pour a liquid from a first drum to a second drum.

Referring now to FIG. 2 and 7, there is shown drum handling apparatus 10 being utilized to pour a liquid from a drum 81 into a drum 83. The operator activates the linear motors of gripping means 25 so as to retract L shaped members 31 and 33 thereby allowing curved plates 69 and 71 to grip drum 81. The operator then raises drum 81 to a height above drum 83, positions a bung valve 85 located on the top end of drum 81 above a funnel 87 extending from the top end of drum 83 and rotates engaging elements 43 and 45 of tire handling mechanism 11 to a position which will allow liquid to pour from drum 81 into drum 83 as is best illustrated in FIG. 7. The operator then opens valve 85 allowing the liquid in drum 81 to pour from drum 81 into drum 83.

From the foregoing, it may readily be seen that the present invention comprises a new, unique, and exceedingly useful drum handling apparatus which constitutes a considerable improvement over the known prior art. Obviously, many modifications and variations of the present invention are possible in light of the above teachings. It is therefore to be understood that within the scope of the appended claims the invention may be practiced otherwise than as specifically described.

What is claimed is:

1. A fifty five gallon drum handler adapted for use with a tire manipulating attachment having first and second L shaped members with each L shaped member being extendable and retractable from one of a pair of spaced, parallel tubular housings and having a rotatable gripping element positioned at a free end thereof, said fifty five gallon drum handler comprising:

a first tubular shaped member;

a second tubular shaped member in slidable engagement with and telescoping from said first tubular shaped member;

first and second plates connected, respectively, to the free ends of said first and second tubular shaped members;

said first and second plates, respectively, adapted to connect to the rotatable gripping elements of said first and second L shaped members; and engaging means connected to said first and second tubular shaped members for gripping a drum when said first and second L shaped members are retracted, releasing said drum when said first and second L shaped members are extended, and rotating said drum when the gripping elements of said first and second L shaped members are rotated.

2. The drum handler of claim 1 further characterized by first and second stops, respectively, attached to the ends of said first and second tubular shaped members opposite said first and second plates.

3. The drum handler of claim 1 wherein said first and second tubular shaped members are square in cross section.

4. The drum handler of claim 1 further characterized by a plurality of lubrication fittings positioned on said first tubular shaped member.

5. The drum handler of claim 1 wherein said engaging means comprises first and second opposed curved plates attached, respectively, at right angles to said first and second tubular members and extending forward therefrom.

6. The drum handler of claim 1 wherein said engaging means is contoured to grasp a sixteen, thirty five or fifty five gallon drum.

7. A drum handling apparatus adapted for use with a tire manipulating attachment having first and second L shaped members with each L shaped member being extendable and retractable from one of a pair of spaced, parallel tubular housings and having a rotatable gripping element positioned at a free end thereof, said drum handling apparatus comprising:

a first tubular shaped member having at one end thereof a stop and at the opposite end thereof a plate;

a second tubular shaped member in slidable engagement with and telescoping from the end of said first member having said stop, said second tubular shaped member having a stop at the end thereof in slidable engagement with said first member and a plate at the opposite end thereof;

the plates of said first and second tubular shaped members, respectively, adapted to connect to the gripping elements of said first and second L shaped members;

first and second opposed curved plates, respectively, mounted at right angles to and extending forwardly from said first and second tubular members; and said first and second curved plates being adapted to grip a drum when said first and second L shaped members are retracted, release said drum when said first and second L shaped members are extended, and to rotate said drum when the gripping elements of said first and second L shaped members are rotated.

8. The drum handling apparatus of claim 7 wherein said first and second tubular shaped members are square in cross section.

9. The drum handling apparatus of claim 7 further characterized by a plurality of lubrication fittings positioned on said first tubular shaped member.

10. The drum handling apparatus of claim 7 further characterized by first and second braces respectively attached to said first and second tubular shaped members, said first and second braces being adapted to mount said first and second plates, respectively, to said first and second tubular members.

11. The drum handling apparatus of claim 7 wherein said first and second curved plates are contoured to grasp a fifty five gallon drum.

12. The drum handling apparatus of claim 7 wherein said first and second curved plates are contoured to grasp a thirty five gallon drum.

13. The drum handling apparatus of claim 7 wherein said first and second curved plates are contoured to grasp a sixteen gallon drum.

* * * * *